United States Patent [19]

Atia et al.

[11] 4,060,779

[45] Nov. 29, 1977

[54] CANONICAL DUAL MODE FILTER

[75] Inventors: Ali Ezz Eldin Atia, Gaithersburg; Albert Edward Williams, Bethesda, both of Md.

[73] Assignee: Communications Satellite Corporation, Washington, D.C.

[21] Appl. No.: 754,804

[22] Filed: Dec. 27, 1976

[51] Int. Cl.[2] ..... H01P 1/16; H01P 7/06; H01P 1/20

[52] U.S. Cl. ..... 333/73 W; 333/21 A; 333/83 R; 333/83 A; 333/98 R

[58] Field of Search ..... 333/73 W, 83 R, 83 A, 333/73 R, 73 C, 98 R, 98 M, 21 R, 21 A

[56] References Cited

U.S. PATENT DOCUMENTS

| | | | |
|---|---|---|---|
| 2,632,808 | 3/1953 | Lawson, Jr. et al. | 333/73 W |
| 3,697,898 | 10/1972 | Blachier et al. | 333/21 A |
| 3,969,692 | 7/1976 | Williams et al. | 333/73 W |

*Primary Examiner*—Alfred E. Smith
*Assistant Examiner*—Marvin Nussbaum
*Attorney, Agent, or Firm*—Sughrue, Rothwell, Mion, Zinn and Macpeak

[57] ABSTRACT

A plural cavity waveguide filter comprising a plurality of cascaded waveguide cavities each resonating in first and second independent orthogonal modes is disclosed. The cavities may be either square and/or circular resonating in the $TE_{101}$ or $TE_{111}$ modes, respectively. The filter makes it possible to realize the general class of coupled cavity bandpass transfer filter functions by providing that the input and output couplings to the filter be physically connected to the first physical cavity. A general set of canonical couplings can then be achieved within the structure.

10 Claims, 11 Drawing Figures

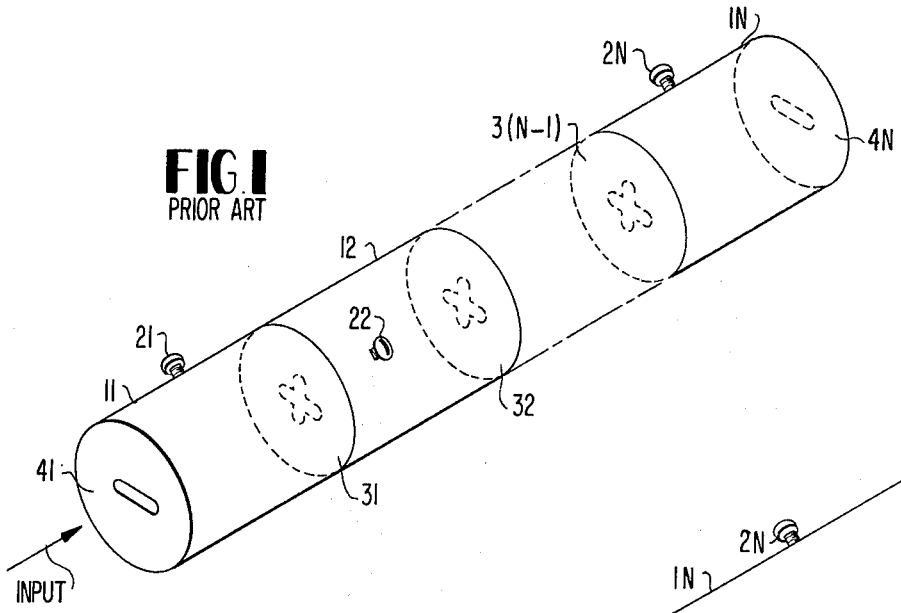
FIG. 1
PRIOR ART
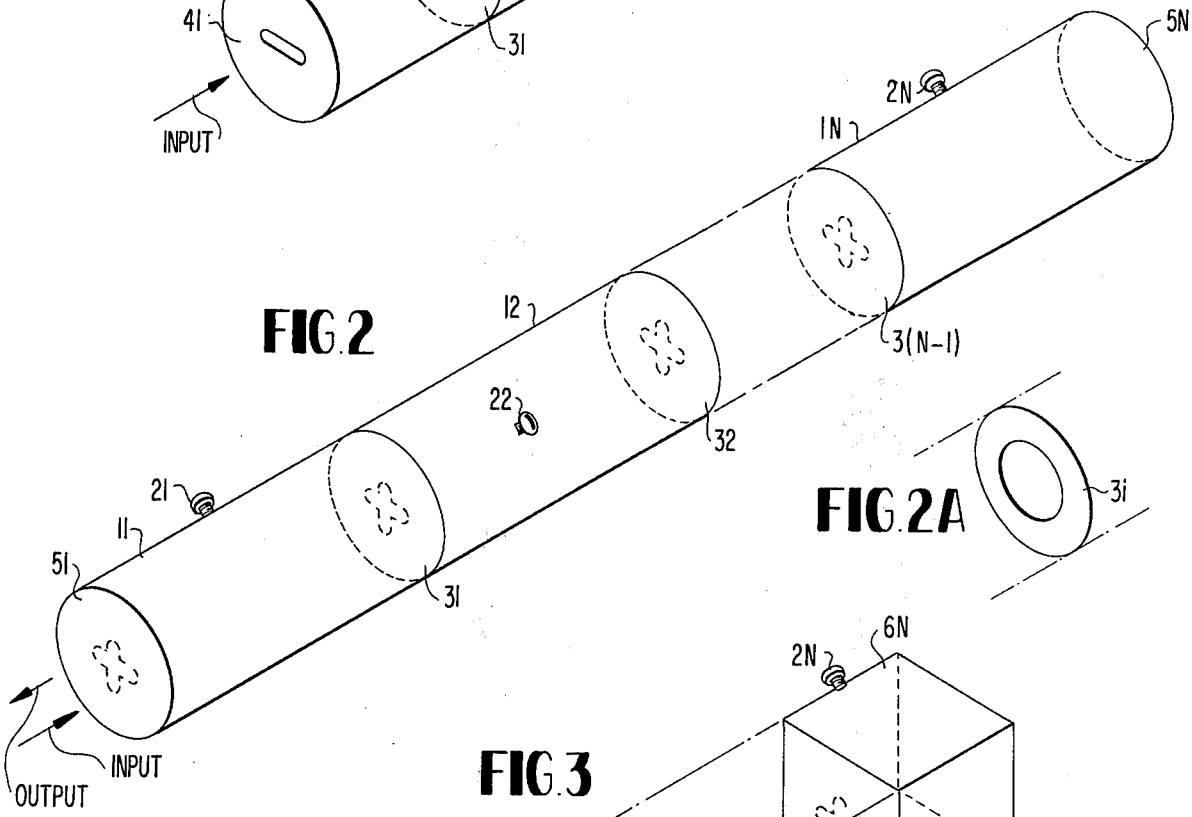
FIG. 2
FIG. 2A
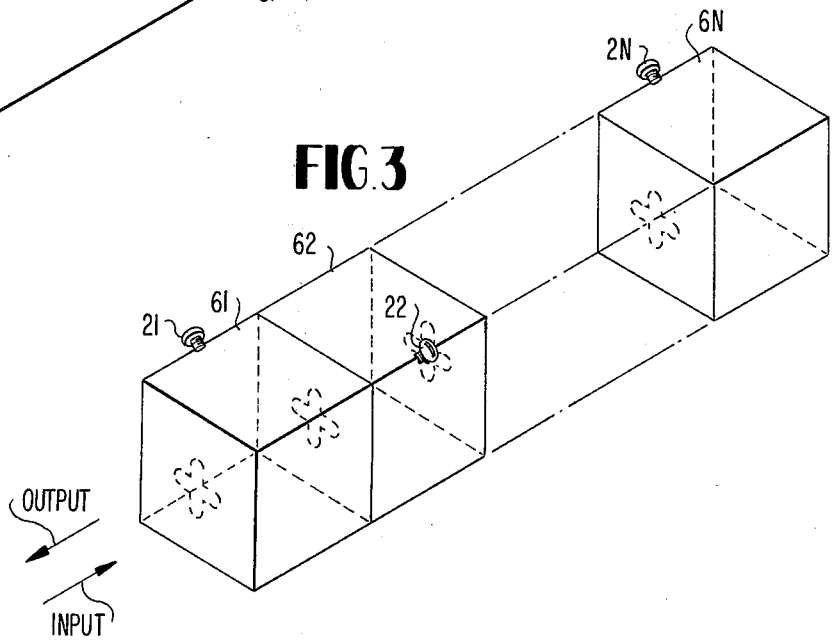
FIG. 3

FIG. 7
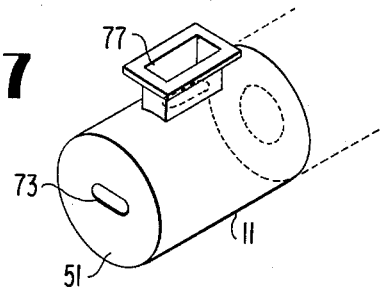
FIG. 8
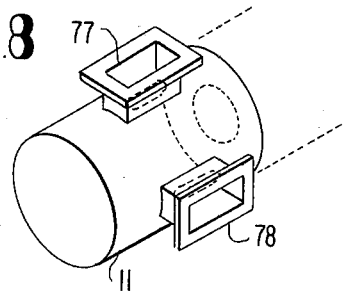
FIG. 9
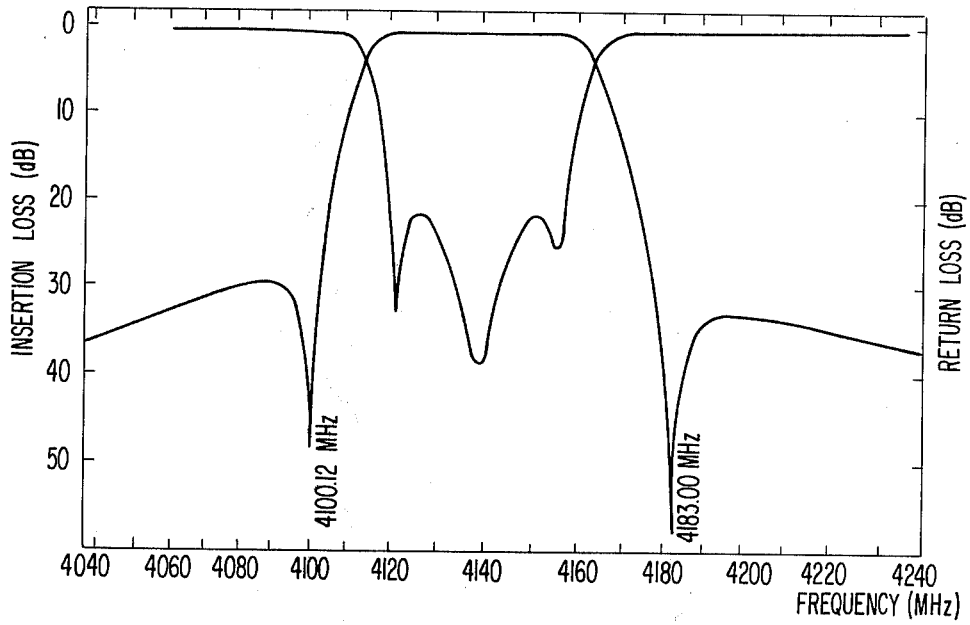
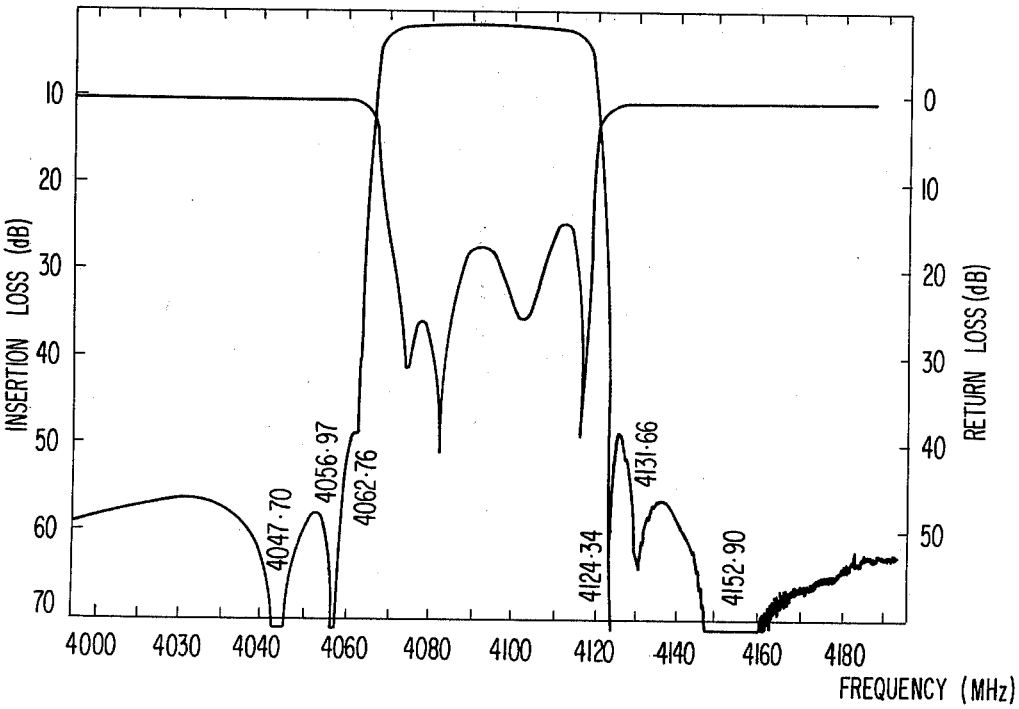
FIG. 10

CANONICAL DUAL MODE FILTER

BACKGROUND OF THE INVENTION

The present invention generally relates to waveguide filters of the type using plural dual mode resonant cavities, and more particularly to an improvement in such filters which makes it possible to realize the general class of coupled cavity transfer functions.

U.S. Pat. No. 3,697,898 to Blachier and Champeau describes a dual mode circular and/or square waveguide filter having input and output ports located at the two physical ends of the filter. More specifically, the Blachier and Champeau filter uses N physical waveguide cavities which resonate in two independent orthogonal modes and are coupled together to provide the filtering capacity of $n=2N$ electrical cavities resonating in a single mode. Intra cavity coupling is provided by a structural discontinuity such as a screw mounted in the cavity wall. Inter cavity coupling is provided by means of selective polarization discriminating couplings between the N cavities to transfer energy between identical modes in the coupled cavities. A particular feature of the Blachier and Champeau filter is the use of a phase inversion means in coupled cavities to provide a subtraction capability between identical modes in the coupled cavities. This substration capability can provide steep response skirts for the passband of the filter.

The Blachier and Champeau filter has significant advantages not only in an improved passband response but also in economies in weight and volume and in the ease of fabrication which results from the realization of two electrical cavities in one physical cavity. However, the Blachier and Champeau filter structure will not realize the general class of coupled cavity transfer functions since no provision to couple electrical cavities 1 and $n$, 2 and $n$-1 and so forth are provided. For a development of a synthesis procedure for the general class of canonical waveguide filters, the reader is referred to the article by Atia, Williams and Newcomb entitled "Narrow-Band Multiple-Coupled Cavity Synthesis" published in the *IEEE Transactions on Circuits and Systems,* Vol. CAS-21, No. 5, September 1974, at pages 649 to 655. The Blachier and Champeau filter is not capable of generating the optimum response and, therefore, the full potential of this particular waveguide cavity structure is not realized.

SUMMARY OF THE INVENTION

The present invention is an improvement in the Blachier and Champeau filter using either square and/or circular dual mode waveguide cavities. As in the Blachier and Champeau filter, intra cavity coupling is provided by structural discontinuities, and inter cavity coupling is provided by selective polarization discriminating irises or circular holes between the cavities. The improvement according to the invention is the provision of a reflective plate in one end cavity and both input and output ports in the other end cavity of the cascaded waveguide cavities. More specifically, the input and output filter ports are connected to the same physical cavity, but the input port is coupled to electrical cavity No. 1 and the output port is coupled to electrical cavity No. $n$. As a result of the improvement according to the invention, it is possible to couple electrical cavities 1 and $n$, 2 and $n-1$ and so forth thereby permitting the realization of the general class of coupled cavity transfer functions. Moreover, all of the advantages associated with the Blachier and Champeau filter are retained.

BRIEF DESCRIPTION OF THE DRAWINGS

The invention will be better understood from the following detailed description with reference to the attached drawings, in which:

FIG. 1 is a generalized illustration of the prior art of Blachier and Champeau dual mode filter employing circular waveguide sections;

FIG. 2 illustrates the canonical dual mode filter according to the present invention using circular waveguide sections;

FIG. 2A illustrates a modification to the basic structure shown in FIG. 2;

FIG. 3 is an illustration of the canonical dual mode filter according to the present invention using square waveguide sections;

FIG. 7 illustrates the use of an end slot and a shunt port in the sidewall in the same end physical cavity to provide the input and output ports of the filters;

FIG. 8 illustrates the use of sidewall waveguide couplings oriented at 90° with respect to one another in the same end physical cavity to provide the input and output ports of the filters; and FIGS. 9 and 10 are graphs showing the experimental response characteristics of fourth and eighth order elliptic function bandpass filters, respectively, built according to the invention.

DETAILED DESCRIPTION OF THE INVENTION

Figure 4:
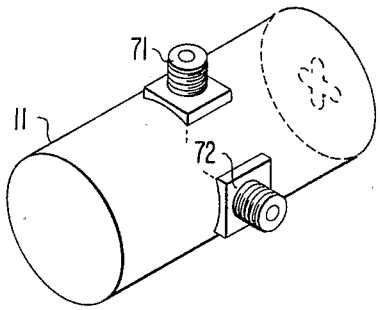
FIG. 4 illustrates the use of perpendicular coaxial probes in the same end physical cavity to provide the input and output ports for the filter.

Since the present invention may be generally considered as an improvement in the basic Blachier and Champeau dual mode filter, this filter will be first described with reference to FIG. 1 of the drawings. The filter comprises a plurality of cascaded waveguide cavities 11, 12 and 1N. As illustrated in FIG. 1, these cavities may be cylindrical waveguide sections connected end to end. It will be understood, of course, that the filter could comprise a plurality of square waveguide sections connected in line. Each of the cylindrical waveguide cavities is capable of resonating at its resonant frequency in first and second independent orthogonal modes. Thus, if the filter comprises N physical cavities, then there are $n=2N$ electrical cavities. If cylindrical waveguide cavities are used, each of the electrical cavities resonates in the $TE_{111}$ mode, whereas if square waveguide cavities are used, each electrical cavity resonates in the $TE_{101}$ mode.

Coupling between the electrical cavities within each physical cavity is provided by a physical discontinuity such as a screw in the side wall. The intra cavity coupling screws 21, 22 and 2N are mounted in their respective cavities at an angle of 45° between the two orthogonal modes supported by the cavity. In addition, certain ones of the coupling screws such, for example, coupling screws 21 and 22, may be shifted by 90° with respect to one another. As a result, the coupling provided by screw 22 has an opposite sign to the coupling provided by the screw 21. This difference in sign in the coupling is a particular feature of the Blachier and Champeau filter which permits the achievement of the particular function response of the filter.

Inter cavity coupling is provided by the plates 31, 32 and 3(N−1) which define the common end walls of successive cavities in the filter. Each of these plates is provided with a cross slot iris which couples like oriented modes in the successive cavities. These irises are polarization discriminating to transfer energy between identical modes in the coupled cavities. Energy is coupled into the filter by means of a slot in the exposed end wall 41 of the first cavity 11, and energy is coupled out of the filter by means of a similar slot in the exposed end wall 4N in the last cavity 1N. The slots in the end walls 41 and 4N are oriented to maximize the coupling of any incoming and outgoing waves having the proper polarization but to minimize the coupling of waves of all other polarizations.

With the Blachier and Champeau filter as illustrated in FIG. 1 as background, the improvement according to the invention will be readily understood with reference to FIG. 2 wherein like reference numerals designate identical or corresponding parts. According to the invention, the exposed end wall of the last cavity 1N is a reflecting plate 5N. At the other end of the filter, the exposed end wall of the first cavity 11 is shown as a plate 51 with a cross slot iris. The purpose here is to illustrate that input and output energy is taken from and coupled to the same end physical cavity 11 of a cascaded set of dual mode cavities. The manner in which the input and output ports of the filter may be actually implemented will be described in more detail hereinafter. The cavity couplings which are made possible by the filter structure shown in FIG. 2 can be represented in the matrix form known as a canonical coupling matrix. A development of this matrix form is provided in the article by Atia, Williams and Newcomb referenced hereinabove. A similar filter composed of square waveguide cavities 61, 62 and 6N is illustrated in FIG. 3.

As in the Blachier and Champeau filter, inter cavity coupling is provided by the plates 31, 32 and 3(N−1) having cross slot irises. For most practical applications, a symmetrical filter structure can be used. In such cases the cascade couplings between electrical cavities 1 and 2 equals that between cavities $n-1$ and $n$, the couplings between electrical cavities 2 and 3 equals that between cavities $n-2$ and $n-1$, and so forth. These cascade couplings are provided by the cross slot irises in plates 31, 32 and 3(N−1). Because of the symmetry of these slots in a symmetrical filter structure, the cross slot irises can be replaced by circular holes. The circular holes have great advantages in the manufacturing and machining processes of those filters as contrasted to the cross slot irises. FIG. 2A illustrates a plate **3*i* having a circular hole. Obviously, the same modification can be made in the structure shown in FIG. 3**.

Figure 5:
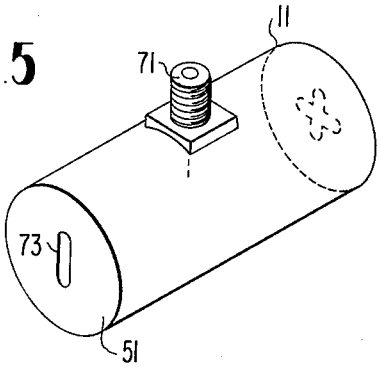
FIG. 5 illustrates the use of a coaxial probe and an end slot in the same end physical cavity to provide the input and output ports of the filters.
Figure 6:
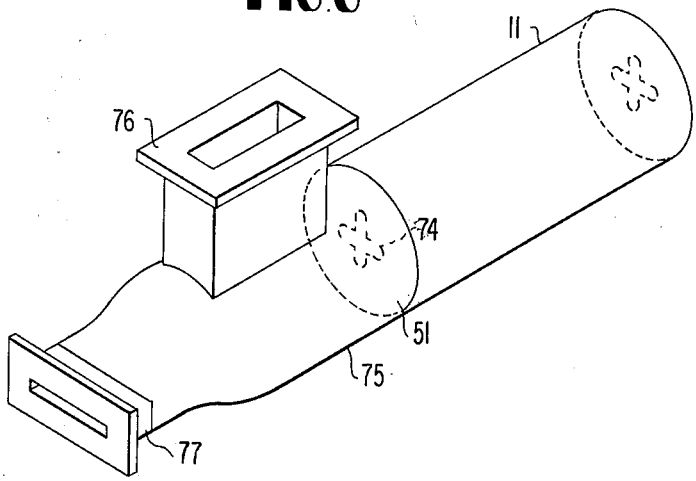
FIG. 6 illustrates the use of a cross slot in an end cavity and an orthogonal mode transducer to provide the input and output ports for the filter.

A cross slot in the exposed end wall of the first waveguide cavity by itself does not provide a practical means for independently coupling the input and output ports to the filter. FIGS. 4, 5 and 6 illustrate three different ways in which the input and output ports may be coupled independently to the two orthogonal electrical cavities within the first physical cavity of the filter structure. In FIG. 4, the exposed end wall of the first cavity 11 is blank and two coaxial probes 71 and 72 are connected to the side wall of the cavity. More specifically, the coaxial probes 71 and 72 are mutually perpendicular with respect to one another and with respect to the longitudinal axis of the filter. Moreover, these coaxial probes are oriented to be in line with the two orthogonal modes in the cavity 11.

In the arrangement shown in FIG. 5, the first cavity 11 is provided with a coaxial probe 71 as before, but instead of a second coaxial probe, the exposed end wall 51 of the cavity 11 is provided with a slot 73. The slot 73 is oriented so as to couple energy orthogonally to the energy coupled by the coaxial probe 71.

In FIG. 6, the cross slot 74 in the end wall 51 of the first cavity 11 as shown in FIG. 3 is retained. An orthogonal mode transducer 75 is connected to this end wall 51. As is well known in the art, an orthogonal mode transducer is capable of independently coupling orthogonally polarized waves. To this end, the orthogonal mode transducer 75 is provided with a shunt port 76 and a series port 77.

In FIG. 7, the first cavity 11 is provided with a shunt port 77 in the sidewall, and the end wall 51 is provided with a slot 73. In this case the slot 73 is oriented so as to couple energy orthogonally to the energy coupled by the shunt port 77.

In yet another variation shown in FIG. 8, two shunt ports 77 and 78 are provided in the sidewall of the first cavity 11. The shunt ports 77 and 78 are oriented about the axis of cavity 11 90° with respect to one another so as to couple energy in two orthogonal modes.

Having described the invention in terms of a preferred embodiment, it will be understood that the invention is an improved waveguide bandpass filter which makes it possible to realize the general class of transfer filter functions. Experimental verification of the fourth and eighth order elliptic function bandpass filter transfer functions has been made at 4GHz, and the results are shown in FIGS. 9 and 10, respectively. As will be appreciated from those figures, theory and experiment were in excellent agreement. The improvement according to the invention is the realization of optimum filter responses by allowing the input and output ports to be coupled to the same end physical cavity of a cascaded set of dual mode cavities.

What is claimed is:

1. In a plural cavity waveguide filter comprising a plurality of cascaded waveguide cavities each resonating at its resonant frequency in a first and a second independent orthogonal mode, first coupling means in each of said cavities for intra cavity coupling of said first mode to said second mode, and second coupling means connecting successive ones of said cavities for inter cavity coupling like oriented modes in said successive cavities, the improvement wherein a reflective plate is provided in one end cavity and both input and output ports are provided in the other end cavity of said plurality of cascaded waveguide cavities.

2. The waveguide filter as recited in claim 1 wherein said waveguide cavities are cylindrical waveguide sections connected end to end by means of said second coupling means.

3. The waveguide filter as recited in claim 2 comprising N physical cavities hereby said filter is equivalent to $n=2N$ electrical cavities resonating in the $TE_{111}$ mode.

4. The waveguide filter as recited in claim 1 wherein said waveguide cavities are square waveguide sections connected in line by means of said second coupling means.

5. The waveguide filter as recited in claim 4 comprising N physical cavities whereby said filter is equivalent to $n=2N$ electrical cavities resonating in the $TE_{101}$ mode.

6. The waveguide filter as recited in claim 1 wherein said input and output ports in said other end cavity comprise first and second coaxial probes oriented mutually perpendicular with respect to one another and with respect to the longitudinal axis of said filter.

7. The waveguide filter as recited in claim 1 wherein said input and output ports in said other end cavity comprise a coaxial probe in a side wall and a coupling slot in the exposed end wall of said other end cavity.

8. The waveguide filter as recited in claim 1 wherein said input and output ports in said other end cavity comprise a cross slot in the exposed end wall of said other end cavity and an orthogonal mode transducer coupled to said exposed end wall of said other end cavity.

9. The waveguide filter as recited in claim 1 wherein said input and output ports in said other end cavity comprise a shunt port in a sidewall and a coupling slot in the exposed end wall of said other end cavity.

10. The waveguide filter as recited in claim 1 wherein said input and output ports in said other end cavity comprise two side wall shunt ports, said side wall shunt ports being oriented about the axis of said other end cavity 90° with respect to one another.

* * * * *